United States Patent [19]

Peterson

[11] 4,427,619

[45] Jan. 24, 1984

[54] CONCRETE FORMING SYSTEM AND METHOD OF USING IT

[76] Inventor: Carl W. Peterson, 8682 San Servera Dr., W., Jacksonville, Fla. 32217

[21] Appl. No.: 181,087

[22] Filed: Aug. 25, 1980

[51] Int. Cl.[3] ..... B28B 1/14; B28B 7/06; B28B 7/34; B28B 7/36

[52] U.S. Cl. ..... 264/333; 264/337; 249/122; 249/134; 249/142; 249/144; 249/145; 249/150; 249/175

[58] Field of Search ..... 269/256, 333, 334, 318; 249/83, 91, 64, 115, 142, 145, 149, 150, 175-177, 184, 112, 114, 127, 134, 122, 173, , 185, 186, 163, 134; 528/170; 425/DIG. 44; 428/421; 52/19-21; 264/331.14, 337, 213, 338, 333, 334, 256

[56] References Cited

U.S. PATENT DOCUMENTS

| | | | |
|---|---|---|---|
| 778,868 | 1/1905 | Kinney et al. | 249/149 |
| 782,797 | 2/1905 | Phelan | 249/184 |
| 847,454 | 3/1907 | Baldwin | 249/175 |
| 1,146,397 | 7/1915 | Bourquin | 249/149 |
| 1,398,412 | 11/1921 | Barkschat | 249/165 |
| 1,515,057 | 11/1924 | Ledyard | 249/149 |
| 1,570,915 | 1/1926 | Nose | 249/150 |
| 2,204,875 | 3/1955 | Kingston | 249/145 |
| 2,623,259 | 12/1952 | Schuh | 249/145 |
| 2,683,298 | 7/1954 | Fadden | 249/145 |
| 3,084,390 | 4/1963 | Anderson | 425/DIG. 44 |
| 3,248,758 | 5/1966 | Schmitz et al. | 249/134 |
| 3,296,211 | 1/1967 | Winkler et al. | 528/301 |
| 3,332,187 | 7/1967 | Arcari | 249/90 |
| 3,363,876 | 1/1968 | Moore | 249/184 |
| 3,414,951 | 12/1968 | Schulze | 249/145 |
| 3,542,327 | 11/1970 | Herzog | 249/160 |
| 3,833,545 | 9/1974 | Livschitz et al. | 528/70 |
| 3,976,741 | 8/1976 | Lowe et al. | 264/334 |
| 3,988,103 | 10/1976 | Hofmeister | 249/184 |
| 4,054,592 | 10/1977 | Dear et al. | 528/70 |
| 4,098,742 | 7/1978 | Mueller | 528/70 |
| 4,102,088 | 7/1978 | Keller | 52/20 |
| 4,177,229 | 12/1979 | Moore | 249/177 |

FOREIGN PATENT DOCUMENTS

| | | | |
|---|---|---|---|
| 1290487 | 9/1972 | United Kingdom | 249/177 |

OTHER PUBLICATIONS

Fieser, "Organic Chemistry", Heath & Co., N.Y. (1950), pp. 179 & 180.

*Primary Examiner*—Willard E. Hoag
*Attorney, Agent, or Firm*—Arthur G. Yeager

[57] ABSTRACT

A form for preparing a poured concrete hollow shape having a transverse hole through a wall of the shape comprising a form of at least one releasable section, a central core for said hollow, and a core for said transverse hole abutting said central core and said releasable section; said transverse hole core having a surface of a fluorocarbon elastomer where said surface is contacted by poured concrete.

22 Claims, 3 Drawing Figures

CONCRETE FORMING SYSTEM AND METHOD OF USING IT

BACKGROUND OF THE INVENTION

The preparation of poured concrete structures is a well known art that has been developed for many years. The preparation of hollow reinforced concrete shapes having smooth precise holes through the walls thereof is a difficult task. One method in use today is to mold the hollow shape and subsequently bore the hole with a diamond tooth drill. This is extremely expensive. Another procedure is to employ a core for the hole and mold the entire structure in one operation. The surface smoothness and precision of the hole size depends on the core and material from which it is made. A core having a polished steel surface is very expensive and the surface deteriorates after being reused a few times, causing the cored hole not to have the desired smoothness and to make the core more difficult to remove with each reuse. Cores made of other materials, such as fiber glass, polyvinyl chloride, rubber, or aluminum, have the same or similar problems of surface deterioration. As the core surface deteriorates it becomes pitted and more and more difficult to remove until it must be hammered out of the concrete structure after the removal of all the outside forms and central core used in preparing a structure. When such a hole core is hammered out of its position the core is frequently damaged or destroyed, usually accompanied by severe damage to the surface of the hole to the extent that precision fittings cannot be applied to the hole. The labor cost of using such cores, and the replacement cost of cores that can only be used a few times results in inordinately high prices for such concrete structures.

It is an object of this invention to prepare a poured reinforced concrete hollow shape having at least one hole through a wall of the shape by using a form in which the core for the hole is readily removed from the solidified shape, leaving a hole with a smooth surface and a precise size.

BRIEF SUMMARY OF THE INVENTION

This invention provides a form for preparing a poured concrete hollow shape having at least one hole through a wall thereof comprising a form of at least one releasable section, a central core for said hollow, and a core for said hole abutting said central core and said releasable section; said hole core having fluorocarbon elastomer surface where that surface contacts poured concrete. In a specific embodiment of this invention the hole core has an interior structure of polyurethane foam and with a fluorocarbon elastomer coating $\frac{1}{4}$ to 1 inch in thickness. In a preferred embodiment the hole core is affixed to the outer form of the concrete structure and removable therewith.

BRIEF SUMMARY OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawing in which:

DETAILED DESCRIPTION OF THE INVENTION

Figure 1:
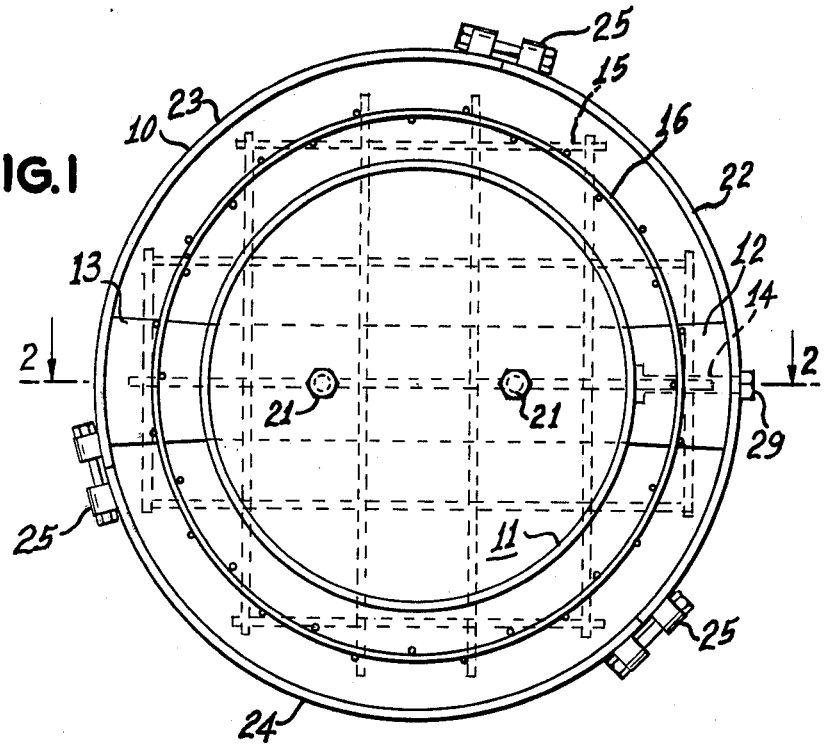
FIG. 1 is a top plan view of the form of this invention.
Figure 2:
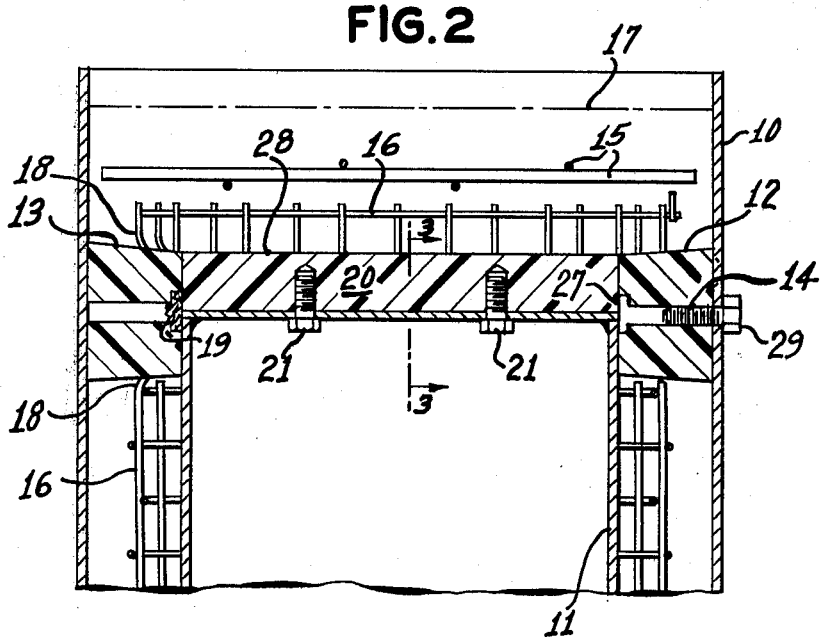
FIG. 2 is a partial cross-sectional view in elevation taken at 2—2 of FIG. 1.

The features of the concrete form of this invention can be understood by reference to FIGS. 1 and 2 where the outside form 10 is positioned around a central core 11 so that concrete may be poured in from the top to a level represented by the broken line at 17 to produce a hollow shape. In the present instance the shape is designed to be a manhole for use in connecting underground water or sewage lines. The bottom of the manhole is represented by the surface at 17 and, hence, the arrangement in FIG. 2 is positioned for pouring concrete into the form even though the final structure of concrete will be turned upside down for its intended use as a manhole.

Since these structures are relatively large, reinforcing means are needed to provide the final concrete structure with its desired strength properties. Reinforcing bars 15 are shown in a network at the bottom of the concrete shape and a cylindrical arrangement of reinforcing steel wire mesh 16 is shown in the volume between outside form 10 and central core 11. The arrangement, size, and installation of such reinforcing steel members is not a part of this invention and is designed and assembled by procedures and means well known in the art.

In manhole structures there is at least one, and more commonly at least two, holes through the wall of the manhole near the bottom of its interior volume. These holes are connected to underground pipes such that the flow through the pipe is not interrupted and yet a person can descend into the manhole from above the surface of the ground and inspect the flow of water or sewage through the pipe in order to repair or to maintain it in operating condition. In these drawings hole cores 12 and 13 are shown at diametrically opposite positions and spanning therebetween is a form 20 to produce a U-shaped channel. It is, of course, entirely feasible for cores 12 and 13 not to be in line with each other (180° apart) but rather to be at an angle with each other (90°, 135°, etc.) and to be at different elevations with respect to the bottom 17 of the structure. In the event that the arrangement is other than 180° channel-producing form 20 must be correspondingly changed to span between the two cores 12 and 13, whatever their positions may be.

Two different arrangements are shown for positioning hole cores 12 and 13. In the instance of core 12 there is a central hole in the core formed to receive one or more flat head bolts 14 with the head of the bolt set in a countersunk portion of core 12 and the shank of the bolt extending far enough to be attached with a nut 29 to outside form 10. In some instances countersinking is not necessary, if the material from which cores 12 and 13 are made is such that the head of the bolt will embed itself within the surface of the core upon tightening of nut 29. The size and shape of the flat head of bolt 14 is designed to match the countersink in core 12 as closely as possible so that interior surface 27 is smooth and continuous. If any depressions, cavities, or the like, are present around the flat head of bolt 14, they may be filled with putty or covered with tape so as to produce a smooth interior surface 27 of core 12. This means for positioning core 12 is employed when it is important to have a precise location of the hole through the wall of the concrete shape being formed as when the hole cores must align with a channel form 20.

With respect to core 13 the central bore 19 which at other times would receive a flat head bolt 14, is plugged with putty or any substance which will prevent the poured concrete from entering the hole because in this arrangement a bolt is not employed. Core 13 is held in place by the cut and bent edges 18 of reinforcing wire mesh 16. This arrangement is employed when there is no need for a precise location of the transverse hole through the wall of the concrete shape. In both the instances of cores 12 and 13 there is a squeezing action applied to the outside surface and the inside surface of each core by outside form 10 and central core 11, and this squeezing action assists considerably in maintaining the cores in their desired locations. In order for cores 12 and 13 to fit snugly and properly with outer forms 10 and central core 11 it will, of course, be necessary that the inner surfaces of the cores be concave to substantially match the curvature of central core 11 and the outer surfaces be convex to substantially match the inner surface of form 10.

In an alternative embodiment outer form is fashioned with tubular protrusions at the location of desired transverse holes through the wall of the concrete structure. Each tubular protrusion is large enough for core 12 or 13 (with zero taper) to fit slidably therein as a piston fits into its cooperating cylinder. When outer form 10 and central core 11 are positioned properly cores 12 and 13 may be pushed inwardly through their respective tubular protrusions to press against central core 11 and be held in that position during the pouring of the concrete. When the concrete structure has cured cores 12 and 13 can be retracted into their respective protrusions and outer form 10 removed from the structure. Any desirable means can be employed to move cores 12 and 13 forward or back in their tubular protrusions, e.g. a threaded shank, hydraulic piston rod, etc.

If there is a channel in the bottom of the concrete shape to join the side wall holes produced by cores 12 and 13, central core 11 is shortened sufficiently to permit channel form 20 to be attached to the bottom (top in the position shown) of central core 11. In this instance the attachment is seen to be made by two screws 21 although other attaching means may be employed. Form 20 merely produces a U-shaped channel approximately ½ the depth of the hole produced by cores 12 and 13. If there is to be no channel in a particular concrete shape form 20 will be eliminated and central core 11 will extend to surface 28.

In FIG. 1 there is shown an arrangement of outer form 10 with three partable or disassemblable sections 22, 23, and 24. It is not necessary that there be three sections. In some instances a design of two sections would be suitable, and in other instances more than three sections would be desirable. In still another arrangement outer form 10 can be a single piece of metal with its two ends joined to produce a cylindrical form. Clamps 25 are shown as a means for joining sections 22, 23, and 24 to each other. The exact design of clamps 25 is not important, since any of several means can be employed for the same purpose. It is only important that these means be suitable to hold form 10 in fixed position and to be readily releasable so as to remove the outside form when the poured concrete has solidified sufficiently to self-sustaining.

Figure 3:
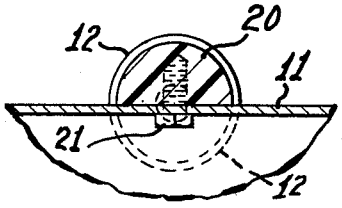
FIG. 3 is a partial cross-sectional view taken at 3—3 of FIG. 2.

In FIG. 3 there is shown the detail of the structure of form 20 which is attached to bottom of central core 11 and is designed to produce a channel in the bottom inside surface of the concrete shape to join the holes produced by cores 12 and 13. It will be seen at the channel matches approximately ½ of the perimeter of cores 12 and 13 to produce a U-shaped channel in the bottom floor of the concrete structure.

An important aspect of this invention is found in the composition and structure of cores 12 and 13. These cores are normally tapered slightly in the usual manner to permit easy removal of the core after the concrete has set, but because of the particular composition of cores 12 and 13 this taper may actually approach or reach zero. Cores 12 and 13 are made of a solid interior mass sufficiently rigid to resist distortion under the stresses encountered in assembling the form and pouring the concrete. The surfaces of the cores that contact concrete must be a fluorocarbon elastomer that has no adhesive affinity for concrete and is sufficiently tough and abrasion resistant to retain its smooth surface after repeated use as a core. The interior of the core may be a plastic semi-rigid foam, such as that provided by a hard polyurethane foam. The characteristics of this foam should be that it is tough with substantially no resiliency. This interior mass of foam is then coated completely with a fluorocarbon elastomer to provide a continuous surface which is smooth and totally unaffected by concrete form oils, or other materials used in the casting of concrete, and which has frictional characteristics that permit the core to be removed very easily from the solidified concrete that surrounds it. The interior of the core may be solid or have large void spaces, so long as the core is strong enough to retain its shape under the stresses encountered. Any type of material may be employed for the interior. The exterior must, however be the fluorocarbon elastomer. The entire core may, of course, be the fluorocarbon elastomer. Heavy-hammering is not necessary to release the core from the solidified concrete. The removal is so easily accomplished that the core can be rigidly affixed to the outside form 10 and when the form is removed from the solidified structure, hole core 12 is simultaneously removed from the concrete structure. The preparation of a concrete structure with holes through the walls is thereby a much easier task than has ever been possible in the past. Insofar as is known it has never been possible to remove the core for a transverse hole concurrently with the outside form, i.e., the core always remained in the structure after the outside form was removed and was later removed separately from the structure.

There are many specific types of fluorocarbon elastomers available today and any of those that are abrasion resistant and have no affinity for concrete are suitable. A typical composition for this purpose is Fluorothane PO-650 sold by The Fluorocarbon Company. Thicknesses of the coating which are usable may vary depending upon the type of concrete structure which is being prepared, but generally they range from ¼ inch to 1 inch. The hole cores of this invention can be employed over and over again if substantial abuse is eliminated. The core surface becomes smoother with use to provide a smoother hole of precise dimensions.

The forms and cores of this invention may be employed in the manufacture of concrete pipe, manholes, and other hollow structures, regardless of shape, where there is a necessity to mold a transverse hole through the wall of the structure. In a manhole it is particularly important to produce a smooth-surfaced hole of reasonably precise dimensions, so that a good fit can be obtained with a flexible gasket connection for joining a pipe to the manhole, and this invention provides the means for accomplishing that purpose economically and efficiently.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A method of preparing a poured reinforced concrete hollow shape having at least one hole through said wall of said shape comprising (1) preparing a suitable form for said shape including a central form core, an outer form wall defined by at least two releasable sections, at least one transverse hole core having an interior of a substantially nonresilient rigid plastic foam exteriorly coated throughout with a fluorocarbon elastomer and squeezingly adjoining said central core and one of said releasable sections to inhibit concrete from entering therebetween, and reinforcing steel means between said central form core and said outer form wall;

(2) pouring concrete into said form and allowing the concrete to set;

(3) removing said outer form wall and said hole cores;

(4) removing said set concrete shape from said central form core; and (5) recovering said reinforced concrete hollow shape with a smooth unspalled transverse hole produced by said fluorocarbon elastomer coated rigid plastic foam hole core.

2. The method of claim 1 wherein said hole core is rigidly affixed to one of said sections, said one section and said affixed hole core being removed simultaneously from said hollow shape without disturbing the connection therebetween.

3. A method of preparing a poured reinforced concrete hollow shape having at least one hole through said wall of said shape comprising (1) preparing a suitable form for said shape including a central form core, an outer form wall defined by at least one releasable joint, including disposing at least one transverse hole core having an exterior outer surface in contact with any concrete coated with a fluorocarbon elastomer and having ends coated with a fluorocarbon elastomer, squeezing said transverse core between said central core and said outer form wall to inhibit concrete from entering therebetween, and disposing reinforcing steel means between said central form core and said outer form wall;

(2) pouring concrete into said form and allowing the concrete to set;

(3) removing said outer form wall and said hole core;

(4) removing said set concrete shape from said central form core; and (5) recovering said reinforced concrete hollow shape with a smooth unspalled transverse hole produced by the fluorocarbon elastomer outer surface of said hole core.

4. A method of pouring concrete to form a self-sustaining cured concrete structure comprising the steps of (1) preparing a form having at least one releasable joint, said form including a central form and an outer wall form, (2) attaching at least one core covered with fluorocarbon elastomer to said outer form and squeezing the elastomer covered core between said central form and the outer wall form to seal joints between said core and said central form and said outer wall form to exclude concrete therefrom, (3) pouring concrete into the form covering the core, (4) allowing the concrete to set, and (5) releasing the joint to remove the form and the attached core simultaneously from the set concrete structure without removal of the core from the form.

5. The method of claim 4 wherein the step of attaching includes (6) attaching another core to the form with the other core extending laterally of the form and being generally oppositely disposed to the one core.

6. The method of claim 4 wherein the surfaces of the core being contacted by concrete consist essentially of a fluorocarbon elastomer.

7. The method of claim 6 wherein the core has an interior of polyurethane foam coated by the fluorocarbon elastomer.

8. A transverse hole core for use in the preparation of poured reinforced concrete hollow shapes having a transverse hole through a sidewall of a hollow shape conprising a generally solid mass of a substantially nonresilient rigid plastic foam with a continuous smooth outside coating $\frac{1}{4}$ to 1 inch thick of a fluorocarbon elastomer, said core having an outside configuration to conform to the desired inside surface of a transverse hole through a sidewall of a hollow shape, said hole core having opposite end surfaces, said end surfaces conforming in shape to and being such as to form seals against the ingress of concrete respectively to an inside form and an outside form forming a concrete hollow shape when installed between an inside form and an outside form.

9. The core of claim 8 which additionally comprises an axial hole therethrough and a recess about said axial hole in one said end surface to accommodate a flathead bolt such that the upper surface of the bolt flathead is in the same plane as said one end surface to form a smooth continuous surface therewith.

10. The core of claim 8 which is generally in the shape of a truncated cone, one said end surface being smaller and transversely convex and the other said end surface being transversely concave in the same transverse direction as said one end surface.

11. A form for preparing a poured concrete hollow shape having at least one hole through a wall of the shape, comprising an outside form of at least one releasable and joinable joint, a central form for said hollow, and a core for said hole abutting each of said central core and said outside form; said core having a fluorocarbon elastomer surface wherein said surface contacts poured concrete to inhibit abrasion to said core by concrete and provide substantially no adhesive affinity to concrete, said core squeezingly being sealed between said central form and said outside from whereby concrete is inhibited from entering therebetween.

12. A form for preparing a poured, reinforced concrete manhole having a hole through the sidewall into the hollow thereof for a pipe connection comprising a central form; at least one disassemblable joint which when assembled defines the outside form for the outside surface of said manhole; and a side wall hole core abutting said central form and said outside form at the position for said pipe connection, said side wall hole core having a fluorocarbon elastomer surface to inhibit abrasion to said side wall hole core by concrete and provide substantially no adhesive affinity to concrete, said side wall core squeezingly being sealed between said central form and said outside form whereby concrete is inhibited from entering therebetween.

13. In the form of claim 12 wherein said hole core is affixed to said outside form by at least one bolt extending from the interior of said hole core through said outside form to which it is affixed, and means releasably attached to said bolt outwardly of said outside form to rigidly connect said bolt to said outer form.

14. A form for preparing a poured reinforced concrete manhole having two transverse holes through the sidewall into the hollow of said manhole and a U-shaped channel in the inside bottom surface of the manhole joining the two transverse holes comprising an outer form with at least one disassemblable joint, a central form having an upper surface, two spaced transverse hole cores positioned adjacent said upper surface of said central core on which the bottom inside surface of said manhole is formed by the set concrete, said central form including a suitable elongated conformation on said top surface and having opposite end surfaces abutting end surfaces by respective said transverse hole cores to form a U-shaped channel on the inside bottom surface of the manhole joining said two transverse holes; each of said hole cores and said conformation having a fluorocarbon elastomer surface to inhibit abrasion to said cores and said conformation by concrete and provide substantially no adhesive affinity to concrete, said cores squeezingly being sealed to said central form and said conformation on one said ends and to said outer form on the other said ends whereby concrete is inhibited from entering therebetween.

15. In the form as defined in claim 14 wherein said hole cores include a rigid polyurethane foam interior and said fluorocarbon elastomer surface defines the exterior surface coated onto said foam interior.

16. A form for preparing a poured, reinforced concrete manhole having a hole through the sidewall into the hollow thereof for a pipe connection comprising a central form; a plurality of disassemblable sections which when assembled define the outside form for the outside surface of said manhole; and a side wall hole core abutting said central form and one of said sections at the position for said pipe connection, said side wall hole core being made of rigid polyurethane foam coated with a fluorocarbon elastomer to inhibit abrasion to said side wall hole core by concrete and provide substantially no adhesive affinity to concrete, said side wall core squeezingly being sealed between said central form and said one section whereby concrete is inhibited from entering therebetween.

17. The form of claim 16 wherein said hole core is affixed to one of said sections by at least one bolt extending from the interior of said hole core through said section to which it is affixed, said hole core being removed from set concrete manhold simultaneously upon disassembly of said sections without removal of said hole core from its connection to said one section.

18. The form of claim 16 which additional comprises a network of reinforcing bars in the space adjacently above said central form and a wall of reinforcing steel mesh in the sidewall between said central form and said sections, said hole core being maintained in position by being squeezed between said central form and said one section to inhibit the ingress of poured concrete between said hole core and said central form and said hole core and said section and by nesting against a cut out in said reinforcing steel mesh.

19. A form for preparing a poured concrete hollow shape having at least one hole through a wall of the shape, comprising an outside form of at least two joined and releasable sections, a central form for said hollow, and a core for said hole abutting said central core and one said releasable section; said core having a fluorocarbon elastomer surface wherein that surface contacts poured concrete to inhibit abrasion to said core by concrete and provide substantially no adhesive affinity to concrete, said core squeezingly being sealed between said central form and said one releasable section whereby concrete is inhibited from entering therebetween.

20. The form of claim 19 wherein said core is rigidly affixed to said one releasable section only, said core being removed from the set concrete hollow shape simultaneously upon release and removal of said releasable sections therefrom without removal of said core from its connection to said one releasable section.

21. The form of claim 19 wherein said core has an interior of a rigid polyurethane foam and a coating of said fluorocarbon elastomer.

22. The form of claim 19 which additionally comprises a wall of reinforcing steel mesh between said central core and said outside form, said core being maintained in position by being squeezed between said central form and said outside form to inhibit the ingress of poured concrete between said core and said central form and said core and said outside form, and by nesting against a cut aperture in said reinforcing steel mesh.

* * * * *